US006223012B1

(12) United States Patent
Kumar et al.

(10) Patent No.: US 6,223,012 B1
(45) Date of Patent: Apr. 24, 2001

(54) DEVELOPER UNIT WITH A REPLENISH PORT

(75) Inventors: Ajay Kumar, Fairport; Dhirendra C. Damji, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/447,252

(22) Filed: Nov. 23, 1999

(51) Int. Cl.[7] ..... G03G 15/08
(52) U.S. Cl. ..... 399/258; 399/119; 399/120
(58) Field of Search ..... 399/106, 111, 399/119, 120, 224, 254, 255, 256, 258, 262, 263

(56) References Cited

U.S. PATENT DOCUMENTS 5,448,341 * 9/1995 Nagahara et al. ..... 399/258
5,914,209 * 6/1999 Grushkin ..... 430/106.6

* cited by examiner

*Primary Examiner*—Fred L. Braun
*Assistant Examiner*—Hoang Ngo

(57) ABSTRACT

A developer unit is arranged with a replenish port for adding developer compound to the developer pan. The replenish port is arranged so that developer compound added to the replenish port falls through the port to an inclined ramp at one end of the developer pan. Further, the inclined ramp's angle of incline is arranged to exceed the developer compound's angle of repose. As a result, the added developer compound flows down the ramp and towards the agitator. The agitator, in turn, propels the developer compound towards the donor roll.

14 Claims, 2 Drawing Sheets

DEVELOPER UNIT WITH A REPLENISH PORT

FIELD OF THE DISCLOSURE

This disclosure relates generally to developer units and, in particular, to an improved replenishable developer unit.

BACKGROUND OF THE INVENTION

Developer units, also known as customer replaceable units or "CRU's", are known. Typically, developer units are arranged for mounting in a host printing machine to develop a latent image present on a photosensitive member. A typical developer unit comprises a donor roll (also known as a "mag roll") and contains a supply of developer compound, also known as "toner". The developer unit is arranged for supplying developer compound to the donor roll. The donor roll, in turn, is arranged to provide developer compound to the photosensitive member. Ultimately, the host printing machine produces copies of the developed latent image.

It is desirable for a developer unit to be capable of producing a large number of copies before its supply of developer compound becomes exhausted. As a result, it is thus advantageous for a developer unit to be capable of storing a large quantity of developer compound.

Once a developer unit's supply of developer compound is exhausted, the developer unit must be refilled or replenished with additional developer compound. Some developer units include a replenish port for purposes of replenishing by the user. With this arrangement, the user adds developer compound to the replenish port in order to replenish the developer unit with additional developer compound.

Typical developer units comprise internal agitators arranged to push or propel the developer compound to the donor roll. In large-capacity developer units, typically two (2) or more agitators are used in tandem. With a two-agitator developer unit design, for example, a first agitator is arranged for propelling developer compound to a second agitator. The second agitator, in turn, is arranged for propelling developer compound to the donor roll.

It is known that the developer unit business (industry) is very competitive. To gain competitive advantage, therefore, it is desirable to minimize the unit manufacturing cost of a developer unit. A developer unit's manufacturing cost is based on many cost factors, one key cost factor being the total number of components comprised by the developer unit. As a result, reducing the developer unit's total component count generally also will reduce the developer unit's manufacturing cost.

One cost limitation of a developer unit comprising multiple agitators, therefore, is the cost of the multiple agitator components. Thus, it would be desirable to provide a replenishable developer unit with one (1) agitator.

The problem, therefore, is how to reduce the number of agitators required in a replenishable developer unit, hopefully to a single (1) agitator.

As a result, there is a need for an improved replenishable developer unit.

SUMMARY OF THE INVENTION

In one aspect of the invention, a developer unit comprises a donor roll and a lower housing. The lower housing comprises a developer pan for containing developer compound. The developer pan has a first end near the donor roll and a second end opposite the donor roll. The developer pan further comprises a ramp inclined downwards at a substantially fixed angle from the second end towards the first end, with the fixed angle exceeding the angle of repose of the developer compound.

In another aspect of the invention, a printing machine comprises a developer unit. The developer unit comprises a donor roll and a lower housing. The lower housing comprises a developer pan for containing developer compound. The developer pan has a first end near the donor roll and a second end opposite the donor roll. The developer pan further comprises a ramp inclined downwards at a substantially fixed angle from the second end towards the first end, with the fixed angle exceeding the angle of repose of the developer compound.

DESCRIPTION OF THE PREFERRED EMBODIMENTS

Briefly, a developer unit comprises a donor roll, a developer pan for containing developer compound, and a single agitator. The developer unit also comprises a replenish port for adding developer compound to the developer pan. The replenish port is arranged so that developer compound added to the replenish port falls through the port to an inclined ramp at one end of the developer pan. Further, the inclined ramp's angle of incline is arranged to exceed the angle of repose of the developer compound. As a result, the added developer compound flows down the ramp and towards the agitator. The agitator, in turn, is arranged to propel the developer compound towards the donor roll.

Figure 1:
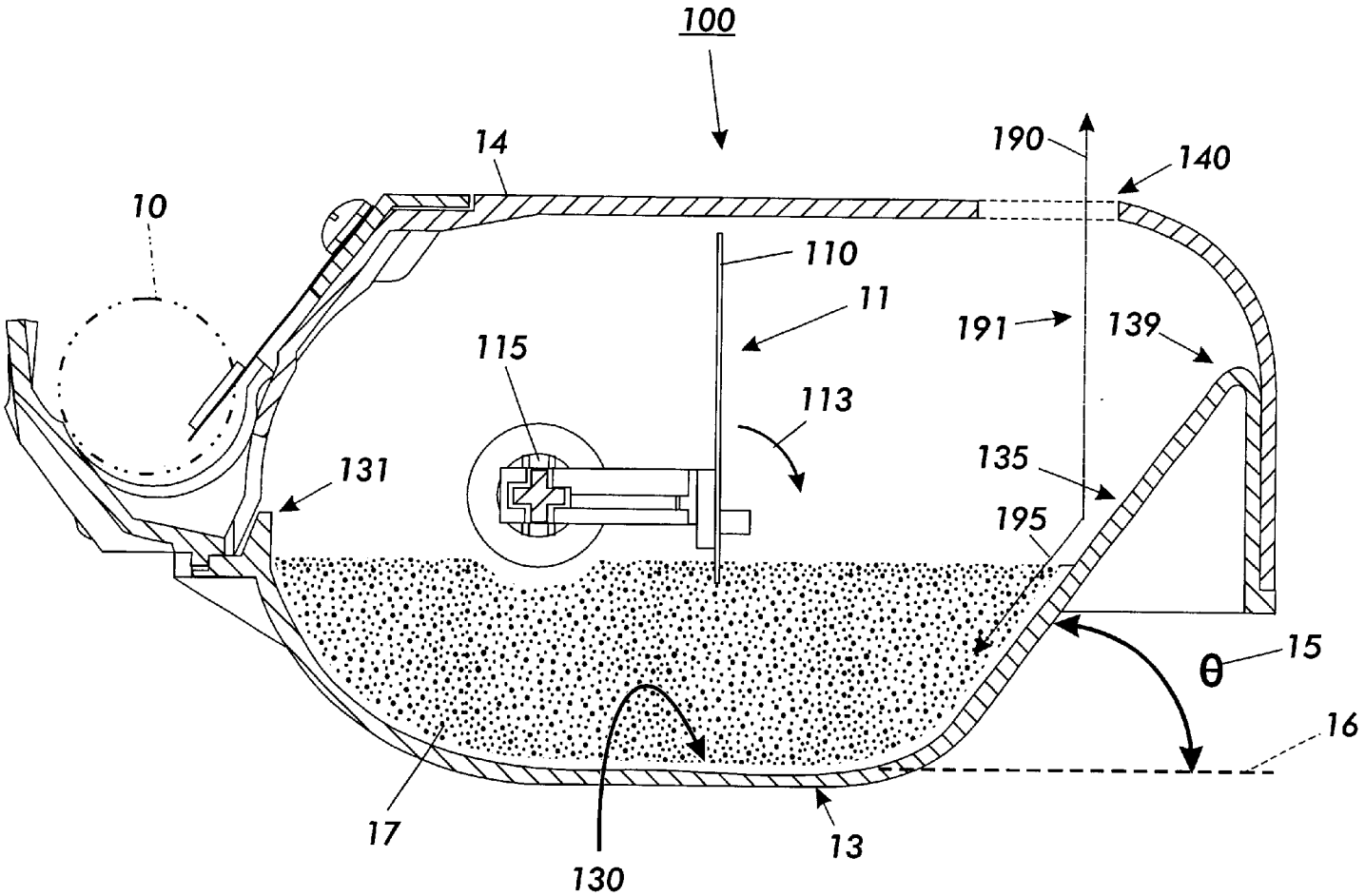
FIG. 1 shows an improved replenishable developer unit, in accordance with the present invention.

Referring now to FIG. 1, there is shown an improved replenishable developer unit 1 00, in accordance with the present invention. The developer unit 100 comprises a donor roll 10 and a lower housing 120. The lower housing 120 comprises a developer pan 13 arranged for containing a quantity of developer compound 17. The developer pan 13 comprises a first end 131 near the donor roll 10 and a second end 139 opposite the donor roll 10.

The developer unit 100 further comprises a single agitator 11 positioned between the first end 131 and the second end 139. As shown, the agitator 11 comprises a paddle 110 arranged to rotate 113 around an axle 115. It will be appreciated that the axle 1 15 is arranged to be rotatably powered by a gear train (not shown). The gear train, in turn, is powered by torque provided by a host printing machine.

Still referring to FIG. 1, the developer pan 13 comprises a ramp 135 located near the second end 139. As shown, the ramp 135 is inclined downwards towards the agitator 11 and the first end 131 at a substantially fixed angle 15 with respect to the horizon 16. The fixed angle 15 of the ramp 135 is selected to exceed the angle of repose of the developer compound 17.

The developer unit 100 further comprises an upper housing 14 enclosing the developer pan 13. The upper housing 14 comprises a replenish port 140 for adding developer compound 17 to the developer pan 13.

The replenish port 140 is aligned with the ramp 135. As a result of such alignment, developer compound 17 added 190 to the replenish port 140 falls 191 by means of gravity to the ramp 135.

As mentioned above, the ramp 135 is arranged so its fixed angle 15 exceeds the angle of repose of the developer compound 17. As a result, the force of gravity causes any developer compound 17 present on the ramp 135 to flow 195 towards the agitator 11. In turn, the agitator 11 is arranged to propel the developer compound 17 towards the first end 131 and the donor roll 10.

As shown, the developer unit 100 exclusively comprises only one (1) agitator, namely, the single agitator 11.

In one embodiment, the fixed angle 15 of incline of the ramp 135 comprises about fifty (50) degrees.

Also in one embodiment, the developer compound 17 comprises SCD toner (known as "EMT-700"), with a corresponding angle of repose 15 comprising about thirty-five (35) degrees.

Figure 2:
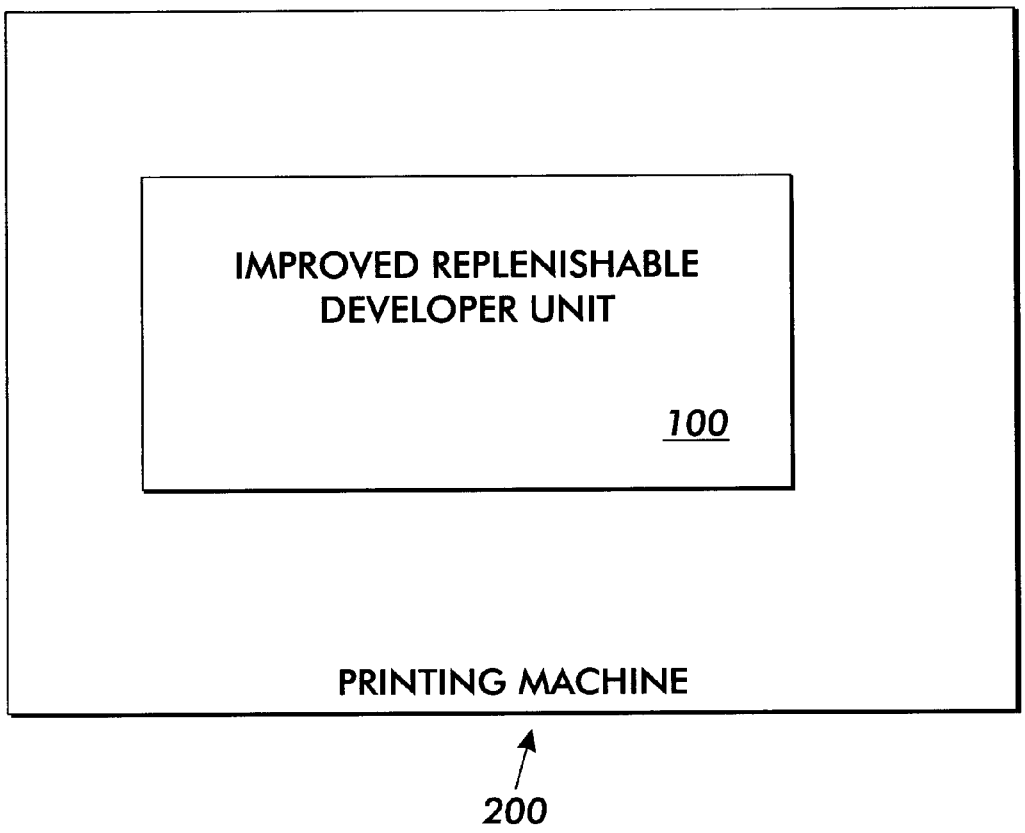
FIG. 2 shows a printing machine having the FIG. 1 improved replenishable developer unit therein.

It will be appreciated that a printing machine may be arranged with an improved replenishable developer unit, in accordance with the present invention. Referring to FIG. 2, for example, there is shown an exemplary printing machine 200 arranged with developer unit 100. It will be appreciated that developer unit 100 depicted in FIG. 2 corresponds to the developer unit 100 depicted in FIG. 1 and described herein.

In one embodiment, the printing machine 200 comprises a compact desktop multi-function digital machine.

Some advantages of an improved replenishable developer unit, in accordance with the present invention, now will be discussed.

To begin, the improved replenishable developer unit 100 comprises only a single (1) agitator, instead of multiple agitator components. As a direct result of reducing the number of required agitators, the total component count of developer unit 100 is advantageously reduced. Moreover, as a result of reducing the total component count, the corresponding unit manufacturing cost of developer unit 100 is thereby advantageously reduced.

As a further advantage of the improved replenishable developer unit 100's single-agitator design, the corresponding gear train required to drive the single agitator 11 is simplified. This simplified gear train, in turn, results in a further advantageous reduction in manufacturing cost of developer unit 100.

A further advantage of the improved replenishable developer unit 100's single-agitator design is related to the fact that the torque required to drive the unit 100's agitator 11 and corresponding gear train ultimately must be provided by the host printing machine 200. Thus, as a result of developer unit 100 comprising a single (1) agitator 11 and corresponding simplified gear train, the total torque required by host printing machine 200 to drive these elements is now also reduced. This reduction of required drive torque, in turn, reduces power consumption by the host printing machine 200.

Moreover, this reduction in power consumption by printing machine 200 comprises a further competitive advantage for the developer unit 100 itself. This is because the printing machine user generally will prefer to use a developer unit that reduces power consumption by the printing machine.

While various embodiments of an improved replenishable developer unit, in accordance with the present invention, have been described above, the scope of the invention is defined by the following claims.

What is claimed is:

1. A developer unit comprising a donor roll and a lower housing, the lower housing comprising a developer pan for containing developer compound, the developer pan comprising a first end near the donor roll and a second end opposite the donor roll, the developer pan comprising a ramp inclined downwards at a substantially fixed angle from the second end towards the first end, the fixed angle exceeding the angle of repose of the developer compound, further comprising an upper housing having a flat surface region enclosing the developer pan, the flat surface region comprising a user replenish port arranged for a user to add developer compound therethrough, the user replenish port occupying only a portion of the flat surface region and positioned near the second end above the ramp so that developer compound added by the user falls through the user replenish port to the ramp below.

2. The developer unit of claim 1, further comprising an agitator between the first end and the second end, the ramp arranged so that developer compound flows towards the agitator.

3. The developer unit of claim 2, the agitator arranged to propel developer compound towards the first end.

4. The developer unit of claim 3, the agitator comprising the sole and exclusive agitator comprised by the developer unit.

5. The developer unit of claim 1, the fixed angle comprising about fifty (50) degrees.

6. A developer unit comprising a donor roll and a lower housing, the lower housing comprising a developer pan for containing developer compound, the developer pan comprising a first end near the donor roll and a second end opposite the donor roll, the developer pan comprising a ramp inclined downwards at a substantially fixed angle from the second end towards the first end, the fixed angle exceeding the angle of repose of the developer compound, further comprising an upper housing enclosing the developer pan, the upper housing comprising a replenish port for adding developer compound to the developer pan, the angle of repose comprising about thirty-five (35) degrees.

7. The developer unit of claim 6, the developer compound comprising SCD toner (EMT-700).

8. A printing machine comprising a developer unit, the developer unit comprising a donor roll and a lower housing, the lower housing comprising a developer pan for containing developer compound, the developer pan comprising a first end near the donor roll and a second end opposite the donor roll, the developer pan comprising a ramp inclined downwards at a substantially fixed angle from the second end towards the first end, the fixed angle exceeding the angle of repose of the developer compound, further comprising an upper housing having a flat surface region enclosing the developer pan, the flat surface region comprising a user replenish port arranged for a user to add developer compound therethrough, the user replenish port occupying only a portion of the flat surface region and positioned near the second end above the ramp so that developer compound added by the user falls through the user replenish port to the ramp below.

9. The printing machine of claim 8, the developer unit further comprising an agitator between the first end and the second end, the ramp arranged so that developer compound flows towards the agitator.

10. The printing machine of claim 9, the agitator arranged to propel developer compound towards the first end.

11. The printing machine of claim 10, the agitator comprising the sole and exclusive agitator comprised by the developer unit.

12. The printing machine of claim 8, the fixed angle comprising about fifty (50) degrees.

13. A printing machine comprising a developer unit, the developer unit comprising a donor roll and a lower housing, the lower housing comprising a developer pan for containing developer compound, the developer pan comprising a first end near the donor roll and a second end opposite the donor roll, the developer pan comprising a ramp inclined downwards at a substantially fixed angle from the second end towards the first end, the fixed angle exceeding the angle of repose of the developer compound, further comprising an upper housing enclosing the developer pan, the upper housing comprising a replenish port for adding developer compound to the developer pan, the angle of repose comprising about thirty-five (35) degrees.

14. The printing machine of claim 13, the developer compound comprising SCD toner (EMT-700).

* * * * *